US006717562B2

(12) United States Patent
Sandoe et al.

(10) Patent No.: US 6,717,562 B2
(45) **Date of Patent: *Apr. 6, 2004**

(54) ACTIVE MATRIX DISPLAY DEVICES AND METHODS OF DRIVING SUCH

(75) Inventors: Jeremy N. Sandoe, Horsham (GB); John R. Hughes, Horley (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 09/801,027

(22) Filed: Mar. 7, 2001

(65) Prior Publication Data

US 2001/0033277 A1 Oct. 25, 2001

Related U.S. Application Data

(63) Continuation of application No. 08/909,918, filed on Oct. 18, 1999, now Pat. No. 6,243,061.

(30) Foreign Application Priority Data

Aug. 16, 1996 (GB) ..... 9617195
Feb. 28, 1997 (GB) ..... 9704149

(51) Int. Cl.[7] ..... G09G 3/36
(52) U.S. Cl. ..... 345/92; 345/89; 345/94
(58) Field of Search ..... 345/91, 96, 210, 345/10, 87, 89, 92

(56) References Cited

U.S. PATENT DOCUMENTS 4,171,524 A * 10/1979 Lorteije et al. ..... 345/60
4,353,062 A * 10/1982 Lorteije et al. ..... 345/147
4,678,282 A * 7/1987 Yaniv et al. ..... 349/42
4,743,096 A * 5/1988 Wakai et al. ..... 345/89
4,945,352 A * 7/1990 Ejiri ..... 345/91
5,091,722 A * 2/1992 Kitajima et al. ..... 345/89
5,159,325 A * 10/1992 Kuijk et al. ..... 340/783
5,280,280 A * 1/1994 Hotto ..... 345/94
5,325,107 A * 6/1994 Ogawa et al. ..... 345/79
5,508,711 A * 4/1996 Okada ..... 345/97
5,614,922 A * 3/1997 Kawaguchi et al. ..... 345/89
5,627,558 A * 5/1997 Hotto ..... 345/94
5,684,501 A * 11/1997 Knapp et al. ..... 345/94
5,852,425 A * 12/1998 Bird et al. ..... 345/92
6,243,061 B1 * 6/2001 Sandoe et al. ..... 345/91
6,271,817 B1 * 8/2001 Wakai et al. ..... 345/91

FOREIGN PATENT DOCUMENTS

EP 0619572 A1 * 10/1994 ..... G06G/3/36
GB 2129182 A * 5/1984 ..... G09G/3/34
GB 2186414 A * 8/1987 ..... G09G/3/36
WO WO9526545 * 10/1995 ..... G09G/3/36

* cited by examiner

*Primary Examiner*—Steven Saras
*Assistant Examiner*—Fritz Alphonse
(74) *Attorney, Agent, or Firm*—Aaron Waxler

(57) ABSTRACT

An active matrix display device of the kind having two terminal non-linear switching devices (15) such as thin film diodes connected in series with the electro-optic, e.g. LC, display elements (12) between associated row and column address conductors (16, 17), in which the display elements are driven using pulse width modulated data signals and a wide range of grey-scale levels is achieved by using selection signals whose form is determined such that the current flow through the switching devices upon selection is controlled in an appropriate manner. To this end, the selection signals can be shaped to provide a more constant charging level over the selection period.

10 Claims, 8 Drawing Sheets

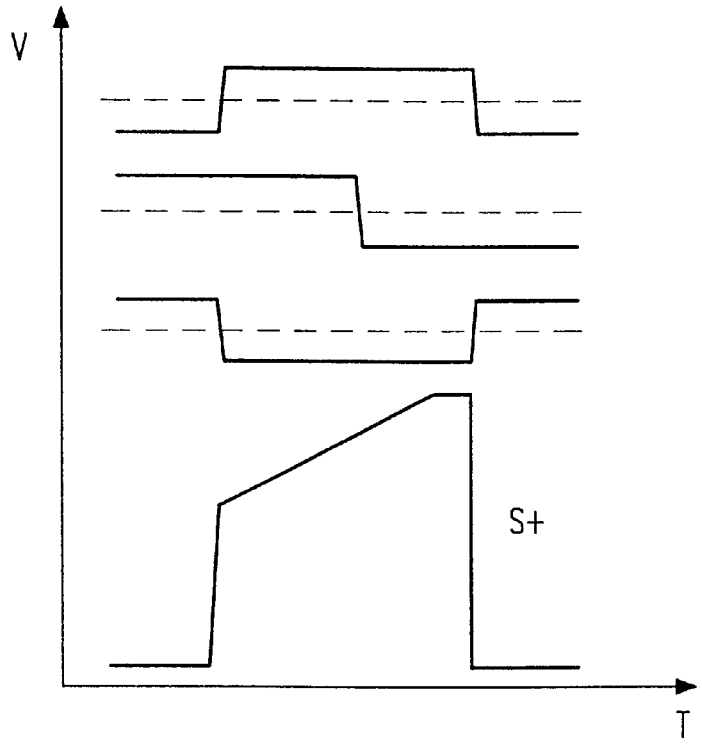
FIG. 9A
FIG. 9B
FIG. 9C
FIG. 9D
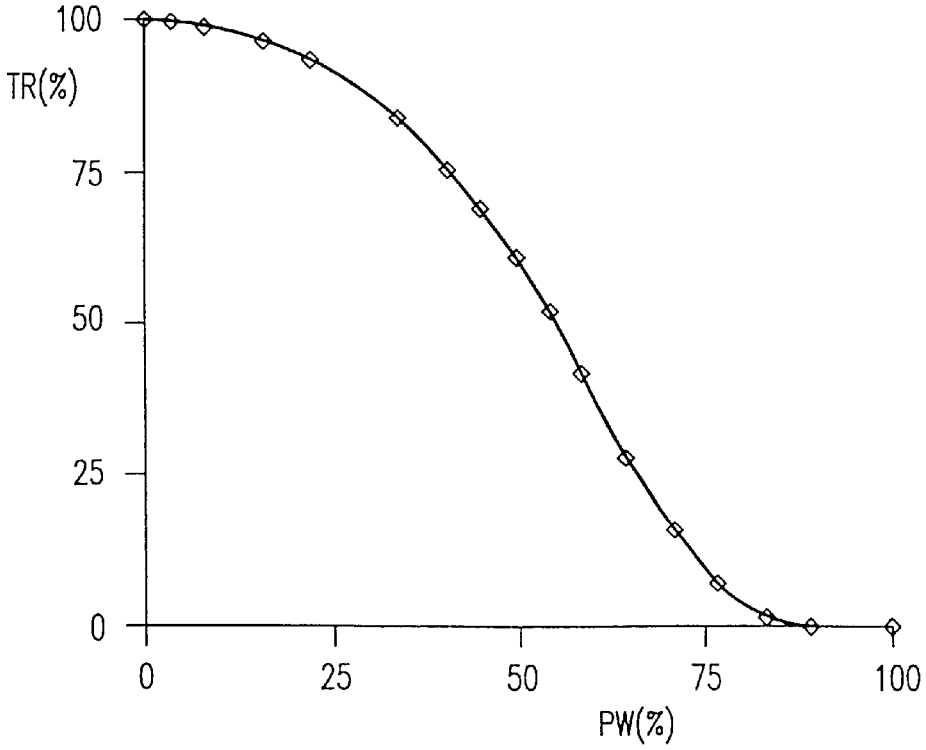
FIG. 10

ACTIVE MATRIX DISPLAY DEVICES AND METHODS OF DRIVING SUCH

CROSS REFERENCE TO RELATED APPLICATION

This is a continuation of application Ser. No. 08/909,918, filed Oct. 18, 1999. Now U.S. Pat. No. 6,243,061.

FIELD OF THE INVENTION

This invention relates to an active matrix display device using two-terminal non-linear switching devices, and in particular a display device comprising sets of row and column address conductors, a row and column array of electro-optic display elements operable to produce a display, each of which is connected in series with a two terminal non-linear switching device between a row conductor and a column conductor, and a drive circuit connected to The sets of row and column address conductors for applying selection signals to the row address conductors to select the rows of display elements and data signals to The column address conductors to drive the selected display elements to produce a required display effect. The invention is concerned also with methods of driving such display devices.

BACKGROUND OF THE INVENTION

The display device may be a liquid crystal display device used to display alpha-numeric or video information. The two terminal non-linear switching devices commonly used in such matrix display devices comprise thin film diode devices, MIMs, diode rings or back to back diodes which are bidirectional and largely symmetrical. The capacitive display elements in these devices are addressed by sequentially applying a selection voltage signal to each one of the set of row address conductors in turn in a respective row address period and applying in synchronised relationship data signals to the other set as appropriate to charge the display elements to a level providing the desired display condition, which following the row address period is subsequently held to maintain the display condition until They are again selected in a following field period. Conventionally, the data signals comprise amplitude modulated (analogue) voltage pulse signals of substantially identical and constant duration, related to the duration of the row address period, and whose amplitudes are varied to determine the display element voltage and produce the display effect required.

Display devices of the above kind and methods of driving such are described in U.S. Pat. No. 5,159,325 and GB-A-2129182. The method described in GB-A-2129182 entails the application to each row address conductor of a four level row drive waveform comprising a selection voltage level for a row selection interval of fixed duration followed by a second, hold, voltage level of less value but of the same polarity as the selection level which serves to hold the switching devices in the row off and which is maintained for at least a major portion of the time which elapses until the row conductor is next addressed so that the display elements are kept substantially at the level to which they were driven for that period. In successive field periods, the polarity of the selection and hold levels is inverted, thus making a four level signal waveform for each row conductor.

The method described in U.S. Pat. No. 5,159,325 employs a five level row scanning drive waveform which includes a reset voltage signal in addition to the selection signals and non-selection (hold) levels. The selection and hold levels are changed for successive fields and, together with the reset voltage signal, which may be regarded as an additional selection signal, form a five level signal waveform. Before presenting a selection signal, which together with the data signals provides the display elements of a row with a voltage of a certain sign, the display elements are charged through their non-linear switching devices to an auxiliary voltage level of the same sign and which lies at or beyond the range of voltage levels (Vth to Vsat) used for display purposes. This drive scheme helps to compensate for the effects of differences in the operating characteristics of the switching devices of the display device. Ideally, these devices should demonstrate substantially identical threshold and I-V characteristics so that the same drive voltages applied to any display element in the array produce substantially identical visual results. Differences in the thresholds, or turn-on points, of the non-linear switching devices can appear directly across the electro-optical material producing different display effects from display elements addressed with the same drive voltages.

Problems can arise if the operational characteristics of the switching devices drift over a period of time through ageing effects causing changes in the threshold levels. Because the voltage appearing across the electro-optic material depends on the on-current of the non-linear device, then if the on-current changes during the life of the display device the voltage across the electro-optic material also changes, which leads to inferior display quality and image storage problems. For switching devices such as thin film diode devices it has been found that this is ageing is due to current stressing effects. In EP-A-0699332 a modification to the form of the selection signals is proposed for reducing the extent of ageing effects. The form of the selection signals is tailored so that the peak current flowing through a switching device upon addressing, and thus the extent of ageing, is reduced. The difference in ageing between switching devices associated with display elements continually driven to different levels is also reduced. This is achieved by arranging that the selection voltage signals applied to the row conductors comprises a shaped voltage pulse signal whose magnitude increases gradually in a controlled fashion to a maximum amplitude during the row address period rather than the usual generally rectangular shape whose leading edge has a rapid and uncontrolled rise time which results in a high peak of current flowing through the device at the start of the selection address period. Through this shaping of the selection signals, the waveform of the current flowing through a switching device has a significantly reduced peak level.

In all these display devices the data signals applied to the display elements via the column conductors comprise amplitude modulated voltage signals whose level, together with the level of the selection signal, determines the voltage level of the display element, and thus its grey scale level, at the end of row address period.

Proposals have been made to drive an LC display device using two terminal non-linear switching devices by means of a pulse width modulation (PWM) drive scheme. This kind of drive scheme can offer attractions in certain types of display applications, particularly datagraphic, as purely digital, and hence for example lower power and less expensive, drive circuit ICs can be used. However, these proposals have generally proved unsatisfactory. GB-A-2186414 describes a PWM drive scheme but this involves a multiplex type drive technique rather than a true active matrix addressing technique. Unlike the above described row drive waveforms which include hold levels between successive selection signals that alternate in polarity in successive, positive and negative, fields the voltage present on the row conductors in the interval between selection signals is the same in both positive and negative fields. This means that the voltage on a display element capacitance decays away during the interval and the main contribution to the rms voltage across the LC display element is a voltage spike which occurs during the row address (selection) period only. The consequence of this is that the response speed of the LC material must be several field periods long in order to avoid flickering effects and this leads to a very slow response to changes in image content. Furthermore, the width (duration) of the selection signal is much more critical and a short selection signal duration can not be achieved without excessive drive voltage levels. In EP-A-0619572 a PWM drive scheme for a MIM LC display device is described in which a four level row drive waveform, having selection signals and hold levels that alternate in polarity in successive positive and negative fields, and similar to that described in GB-A-2129182, is used and in which the data signals determining grey-scale comprise pulse width modulated signals. However, it has been found that the range of grey-scales possible with the drive scheme described is severely limited so that the display device is not suitable for many display applications.

SUMMARY OF THE INVENTION

It is an object of the present invention to provide an active matrix display device using two terminal non-linear switching devices which can be driven using a PWM drive scheme and which is capable of displaying a wide range of grey-scales equivalent, for example, to that available for amplitude modulation of the data signals.

The present invention stems from a recognition that the shaping of the selection signals in the manner envisaged in EP-A-0699332 can be employed beneficially to allow the possibility of the display device being operated, and the display elements driven, in a manner which is different to that used by the display devices in the aforementioned publications and which can be advantageous for certain purposes, in addition to the reduction of ageing effects in the switching devices over a period of operation.

According to the present invention, there is provided an active matrix display device of the kind described in the opening paragraph, in which the data signals comprise pulse width modulated signals whose width determines a desired grey scale output from a display element, and in which the drive circuit is adapted to provide selection signals which comprise voltage pulse signals whose magnitude increases to a maximum voltage amplitude such that the current flowing through a non-linear switching device during the application of a selection signal tends towards a substantially constant value.

The invention is based on an appreciation of the reason for the problem of restrictions on the range of grey-scale possible in LC display devices using two-terminal non-linear switching devices and a pulse width modulation technique. When using conventional selection signals comprising substantially rectangular voltage pulses whose leading edge has a rapid rise time, it is found that the switching device turns on very quickly and that most of the charge supplied to the display element is transferred during an initial, short, part of the duration of the selection signal. Because of the extreme non-linearity between the pulse width of a data signal and the charge in this case, it is not possible to provide a wide range of grey-scales using such a drive scheme. If, however, the switching devices are controlled to give a more constant charging characteristic during a selection signal period then pulse width modulation can be used much more effectively and it readily becomes possible to drive the display elements to a wide range of grey-scales. This desired control of the switching devices is achieved by shaping the pulse signal constituting the selection signal in an appropriate manner. Through such shaping, then instead of most of the charge to (or from) a display element being passed through the switching device in an initial fraction of the duration of the selection signal, the flow of charge is regulated and is more constant over the duration of the selection signal rather than being peaked at the start. Such controlled display element charging (or discharging) rate is better suited for a PWM drive technique and allows a greater range of grey-scales than previously possible. The selection of the amount of charge supplied to the display element, and hence its voltage at the end of the row selection period, as determined by the width of the pulse width modulated data signal, becomes much easier by virtue of the nature of the resulting charge flow characteristic of the switching device.

In a preferred embodiment, the selection signals are shaped such that they initially increase rapidly to a predetermined level below the maximum and are then increased in a gradual and controlled manner, to the maximum amplitude. The gradual and controlled increase may be achieved by ramping smoothly and linearly or in staircase fashion. With such shaping the current flow through the switching device tends to become substantially constant, at a comparatively low level, throughout the selection period, thus enabling a substantially linear relationship between the pulse width and the charge to be realised. In other words, more constant charging during the selection period is achieved.

The selection signal, of a predetermined duration, defines a display element address period during which current can flow through the switching device to drive the display element and the PWM data signal controls the time for which this current actually flows so as to determine the display effect obtained. The data signal may determine the end of the interval within the address period when current flows through the switching device to drive the display element, in which case the beginning of said interval may be determined by the start of the selection signal. Alternatively, the data signal may be arranged to determine the start of the interval within the display element address period in which current flows through the switching device and the termination of this interval may be determined by the end of the selection signal. For this, an initial part of the data signal is preferably ramped in a linear manner to a predetermined voltage level so as to avoid possible current peaks which may occur if the voltage level on the column conductor is switched abruptly during the selection signal address period. With the known kind of row drive schemes in which positive and negative selection signals are applied to the row conductors in successive fields, a combination of these two approaches is preferably used such that in one field the start and end of the current flow interval are determined respectively by the start of the selection signal and the end of the data signal and in the next field the start and end of the interval are determined respectively by the start of the data signal and the end of the selection signal. This enables simplified column conductor signal waveforms to be used. In particular the number of polarity reversals needed in the column signal waveform is significantly reduced.

BRIEF DESCRIPTION OF THE DRAWING

Embodiments of active matrix display devices according to the invention will now be described, by way of example, with reference to the accompanying drawings, in which:

FIG. 9 shows example pulse width modulated data signals and a selection signal in a display device according to the invention;

FIG. 10 graphically illustrates the relationship between the transmission of a typical display element and pulse width modulated signals;

It should be understood that the Figures are merely schematic and are not drawn to scale. The same reference numerals are used throughout the Figures to indicate the same, or similar, parts.

DETAILED DESCRIPTION OF THE PRIMARY EMBODIMENT

Figure 1:
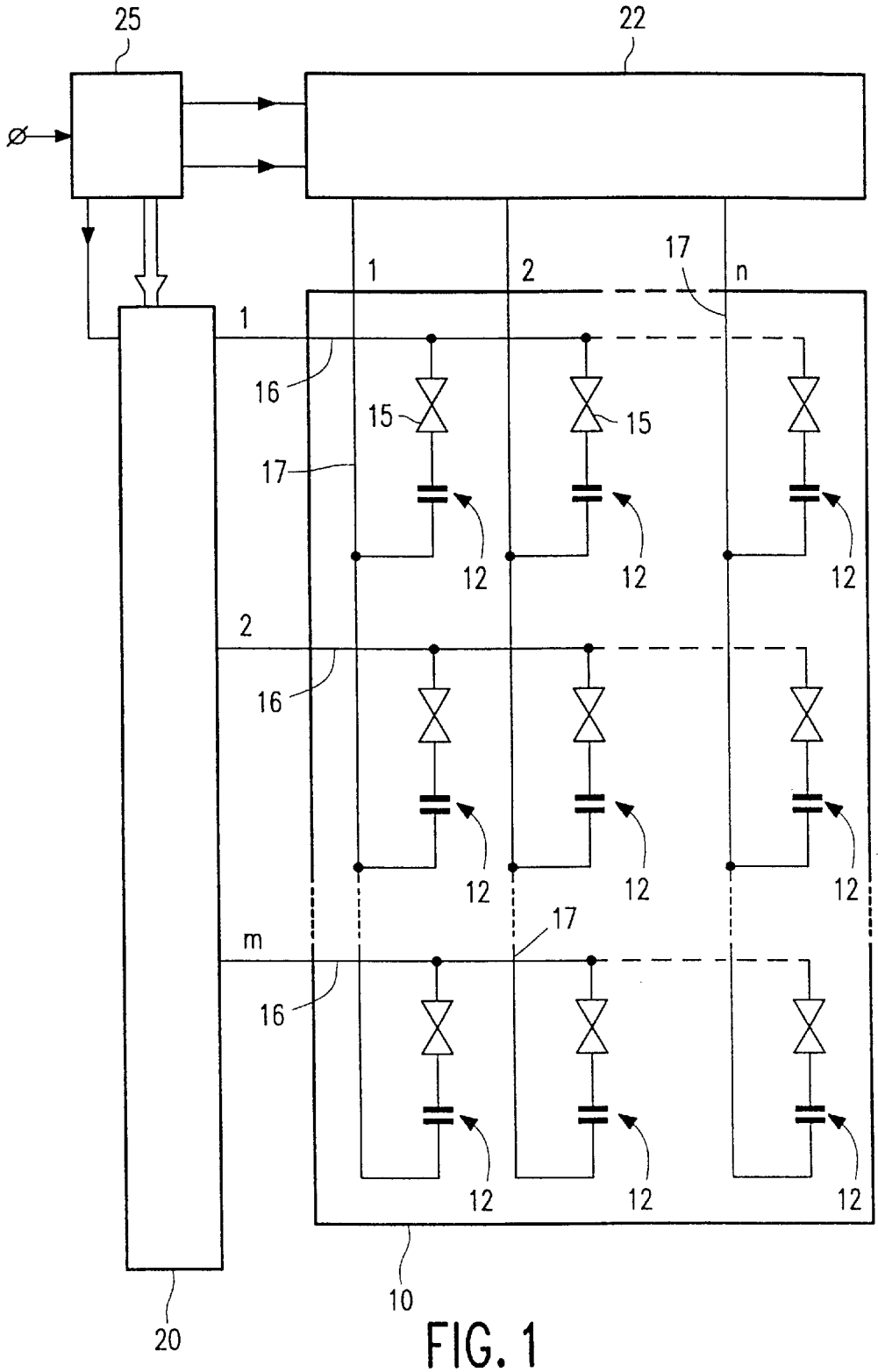
FIG. 1 is a simplified block diagram of an embodiment of an active matrix liquid crystal display device according to the invention.

Referring to FIG. 1, the display device, which is intended for datagraphic display purposes, comprises an active matrix addressed liquid crystal display panel 10 of conventional construction and consisting of m rows (1 to m) with n display elements 12 (1 to n) in each row. Each display element 12, here represented as a capacitor, comprises a liquid crystal display element consisting of two spaced electrodes with twisted nematic liquid crystal material disposed therebetween, and is connected electrically in series with a bidirectional non-linear resistance switching device 15 between a row address conductor 16 and a column address conductor 11. The non-linear device 15 exhibits a substantially symmetrical threshold characteristic and functions in operation as a switching element. The display elements 12 am addressed via the sets of row and column conductors 16 and 17 which are carried on respective opposing faces of two, spaced, glass supporting plates (not shown) also carrying the Opposing electrodes of the liquid crystal display elements. The devices 15 are provided on the same plate as the set of row conductors 16 but could instead be provided on the other plate and connected between the column conductors and the display elements.

The row conductors 16 serve as selection (scanning) electrodes and are addressed by a row driver circuit 20 which applies to each row conductor a row drive waveform including a selection signal component such that a selection signal is applied to each row conductor 16 sequentially in turn. In synchronism with the selection signals, data signals are applied to the column conductors 17 from a column driver circuit 22 to produce the required display outputs from the individual display elements in each row as they are scanned. The selection signal for each row occurs in a respective row address period in which the optical transmissivity of the display elements 12 of the selected row are set to produce the required visible display effects according to the values of the data signals present on the conductors 17. Upon termination of the selection signal at the end of the row address period, the switching devices 15 of the row turn off and the voltages on the display elements of the row are held to maintain their display outputs until the row is next addressed. The individual display effects of the display elements 12, addressed one row at a time, combine to build up a complete picture in one field, the display elements being repeatedly addressed in this manner in subsequent fields. Using the transmission/voltage characteristics of a liquid crystal display element grey scale levels can be achieved. The polarity of the data signal voltages for any given row of display elements is reversed in successive fields to reduce image sticking effects.

The row and column driver circuits 20 and 22 are controlled by a timing and control circuit, generally referenced at 25, to which a video signal is applied and which comprises a video processing unit, a timing signal generation unit and a power supply unit. The row driver circuit 20, like known row driver circuits, comprises a digital shift register and switching circuit to which timing signals and voltages determining the row drive waveforms are applied from the circuit 25. The column driver circuit 22 provides pulse width modulated (PWM) data signals and can be of any known kind capable of supplying this type of data signal. Generally, such circuits are digital circuits, comprising one or more shift register/digital latch circuits together with counter and clock circuits, to which digital video data is supplied and converted to pulse width modulated signals for supply to the column address conductors 17 as appropriate. The video processing unit of circuit 25 supplies the digital video data signals derived from an input video signal containing picture and timing information. Timing signals are supplied by the circuit 25 to the circuit 22 in synchronism with row scanning to provide serial to parallel conversion appropriate to the row at a time addressing of the panel 10. The widths of the PWM data signals supplied to the display elements 12 via the column conductors 17 determine the display outputs from the display elements, the width of a data signal ranging from a maximum width producing a substantially non-transmissive (black) display element to a minimum width producing a substantially fully transmissive (white) display element with intermediate widths producing a range of grey scales, assuming crossed polarisers are used.

The non-linear devices 15 comprise thin film diodes, TFDs, which in this embodiment consist of amorphous silicon nitride TFDs. However other forms of bidirectional non-linear resistance devices exhibiting a threshold characteristic, for example, MIMs, back to back diodes, or other diode structures such as MSM (metal-semiconductor-metal), n-i-n or p-i-p structures may be used instead. All such non-linear devices have a largely symmetrical I-V characteristic.

The row drive waveforms applied to the row conductors 16 are, apart from particular differences which will be described, similar to known kinds of row drive waveforms such as those described in GB-A-2129182 or in U.S. Pat. No. 5,159,325. In the drive schemes described in these publications, the data signals applied to the column conductors comprise amplitude modulated (analogue) voltage signals of substantially identical duration whose amplitudes determine the display element outputs obtained, e.g. greyscales. The kind of row waveform described in GB-A-2129182 is referred to herein as a four level row drive waveform and consists of a row selection voltage signal of a duration corresponding to a row address period and of a certain magnitude followed immediately by a hold signal portion of lower, but similar polarity, voltage for the remainder of the field period to maintain the devices 15 off and isolate the display elements in the row. In successive fields the polarity of the selection signal and hold signal portions are inverted so that the hold and selection signal portions alternate between positive and negative values making four levels altogether. This results in a so-called field inversion drive scheme. The rows of display elements can be addressed using a line inversion mode of drive to reduce perceived flicker. The row drive waveform of the drive scheme described in U.S. Pat. No. 5,159,325, referred to herein as a five level row drive waveform, differs in that, in addition to the selection voltage signals followed by hold, (non-selection), voltage levels, it further includes a reset voltage pulse signal immediately preceding a selection signal for correcting for the effects of non-uniformities in the behaviour of the non-linear devices across the array. The reset voltage signal can be regarded as an additional selection signal and as a result of the reset voltage signal a display element 12 is, in alternate fields, charged (this term being used herein to include discharge where appropriate) to an auxiliary voltage level, which lies beyond one end of the range of display element voltages used for display, just before the display element is set to the required voltage level of the same sign, but of lower magnitude than the auxiliary voltage level, by the application of a following selection voltage signal together with a data signal to the column conductor. In intermediate fields, the display element is driven with a single selection signal and an inverted data signal to drive the display element to a voltage of opposite polarity to that achieved by the selection signal following the reset signal. This scheme leads to a reduction of non-uniformities (grey variations) in the transmission characteristics of display elements which can otherwise occur when driving the rows with periodical inversion of the polarity of both the selection and the non-selection signals, simultaneously with inversion of the data signals. Examples of both kinds of row drive waveforms as used in driving the display device of FIG. 1 are illustrated schematically in FIGS. 2 and 3.

Figure 2:
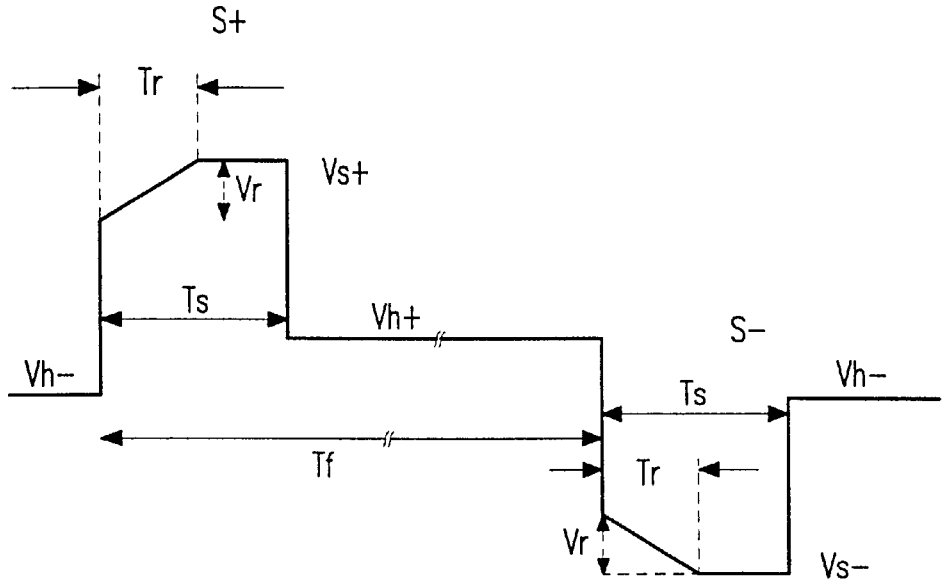
FIGS. 2 and 3 illustrate schematically examples of two forms of row drive waveforms used in driving the display device of FIG. 1.

FIG. 2 shows a four level row drive waveform which consists of a voltage, $V_R$, applied to a row conductor 16 by the row drive circuit 20 having positive and negative selection signal components S+ and S− each of a duration Ts, corresponding to a row address period, which is selected according to the required frame rate. In the case of a VGA datagraphic display for example this may be around 32 $\mu$s. The selection signals S+ and S− are followed respectively by positive and negative hold (non-selection) voltage levels Vh+ and Vh− of lower magnitude but similar polarity for the remainder of the respective field period $T_f$. The data signals are applied simultaneously with the selection signals, the selection signals being operable to turn on the switching devices 15 of the addressed row of display elements and the display elements being charged to a level determined by the data signals. Upon termination of the selection signal, the switching devices 15 turn off and the hold levels Vh+ and Vh− serve to hold the devices 15 off and maintain the voltages on the display elements at their driven level for the rest of the field period. The display elements are driven to opposite polarity levels in successive fields.

Figure 3:
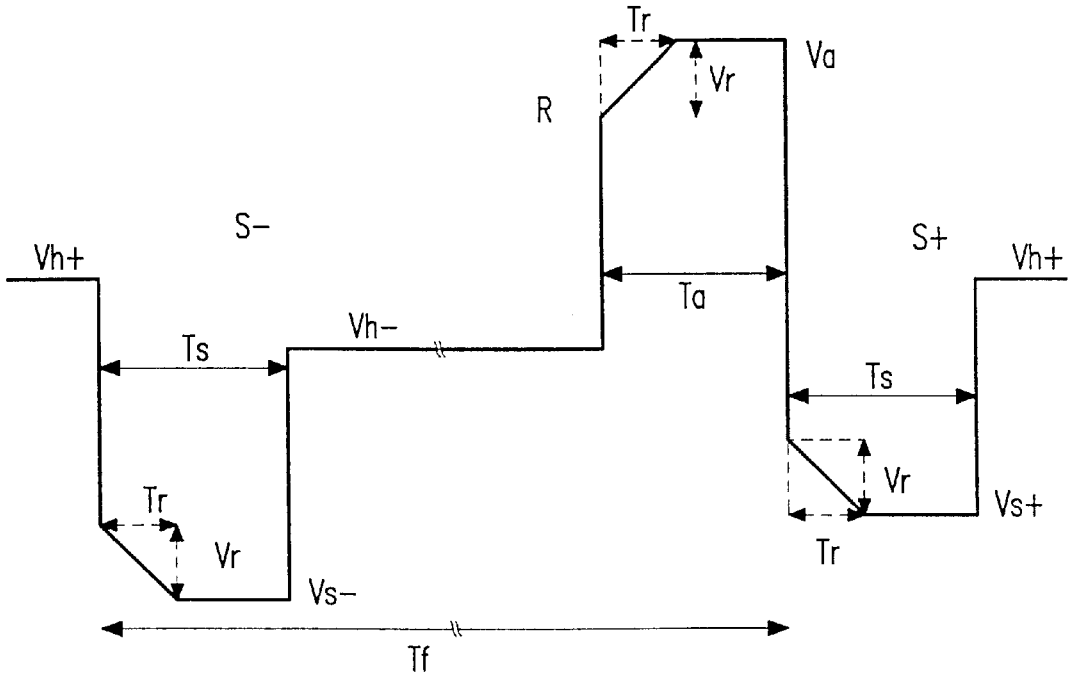

FIG. 3 shows the five level kind of row drive waveform, $V_R$, using in this example a positive reset pulse signal. In one field period, $T_f$, a negative selection voltage signal S− of a duration Ts is presented to a row conductor 16 during a row address period which together with data signals applied to the column conductors is operable to charge the display elements associated with the row conductor to, for example, positive voltages whose levels are dependent on the applied data signals. Upon termination of the selection signal S−, the switching devices 15 turn off and a non-selection, hold, level $V_{h-}$ is applied to the row conductor so as to hold the devices off and maintain the voltage on the display elements at the levels to which they were driven until just before the next selection of the row in the subsequent field. Data having an alternating sign is presented to a display element in successive fields. In the next field, therefore, the display elements are charged to a negative voltage by presenting a positive selection signal. Immediately before this next selection, and in the row address period of the preceding row of display elements, a reset signal R, comprising a positive reset voltage Va, is applied for a reset period Ta, which in this example is slightly longer than Ts, as a result of which the display elements are charged negatively through their switching devices to an auxiliary voltage, dependent on the reset voltage level and the data signal then present on the column address conductors, that lies at or beyond the range of operating voltages used for display (i.e. up to a value less than or equal to Vsat, its black level). The display elements 12 are then charged, in the next field period, to the required display value by means of the immediately following, positive, selection voltage signal S+ applied to the row conductor 16 in the subsequent row address period. Upon termination of this positive selection signal the switching devices turn off and a non-selection, hold, level Vh+ is applied to maintain the display element voltages until they are next addressed with a negative selection signal S−. The voltage across the display elements is inverted every field, and the selected display elements are charged to the required voltages, at which a desired display state is obtained, by passing current in the same direction through the non-linear devices, while the passage of current when the display elements are charged to the auxiliary level is in the opposite direction. The duration, Ts, of each of the selection pulse signals S− and S+ is slightly less than the line period of the incoming video signal, e.g. around 32 microseconds for a VGA datagraphic display, which corresponds to the row address period. Through this drive scheme, the display elements are driven in a line inversion mode of operation in which, in addition to the column drive voltages applied to a display element being reversed in polarity every field, the drive voltages applied to one row of display elements are shifted over one field period plus a row address period with respect to those for an adjacent row and the data signals are inverted for successive rows. The reset voltage pulse R in the described example is positive. Of course, the sign of all the operating voltages, including the data signals could be reversed, thereby making the reset signal negative. Also, the sign of all the operating voltages applied to a row of display elements could periodically be changed during operation if desired, for example after a fixed number of frames.

The waveforms of both FIGS. 2 and 3 differ from those described in GB-A-2129182 and U.S. Pat. No. 5,159,325 in that the selection signals are shaped such that their magnitude increases gradually and in a controlled fashion to a predetermined maximum, in contrast to conventional rectangular signals whose magnitude rises in a rapid and uncontrolled manner with the rise time itself being rapid and ill-defined. The leading (rising) edge of the selection signals S+ and S− has a controlled rise time and the rate of rise of the selection signal is reduced. In these respects, the selection signals are similar to certain forms described in EP-A-

0699332 whose contents in this respect of incorporated herein by reference. In the display device described in this publication, however, such selection signals are used in combination with conventional amplitude modulated, analogue, voltage data signals for the purpose of reducing ageing effects, and in particular differential ageing effects, in the switching devices.

Referring to the selection signals S+ and S− shown in FIGS. 2 and 3, the voltage is initially increased rapidly to a certain level (Vs+−Vr and Vs−−Vr) below the predetermined maximum, Vs+ and Vs− respectively, and is then gradually ramped linearly and smoothly to the maximum over a ramp period, Tr, and thereafter held for the remainder (approximately Ts−Tr) of the selection period. The ramping need not terminate before the end of the signal as shown but could instead extend to the end of the signal. In other words, Tr may be approximately equal to Ts. In the case of the five level waveform the reset signal R can be similarly shaped, as illustrated in FIG. 3, so as to reduce the possibility of differential ageing effects.

Figure 4:
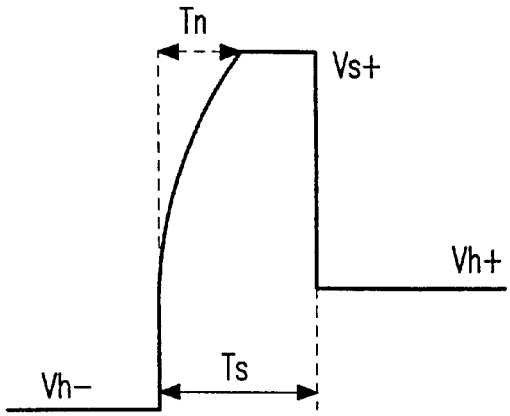
FIGS. 4, 5 and 6 illustrate alternative forms of pulse shaping which can be applied to the row drive waveforms.
Figure 5:
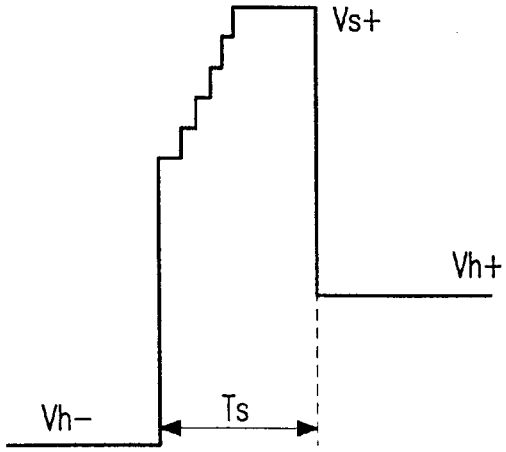
Figure 6:
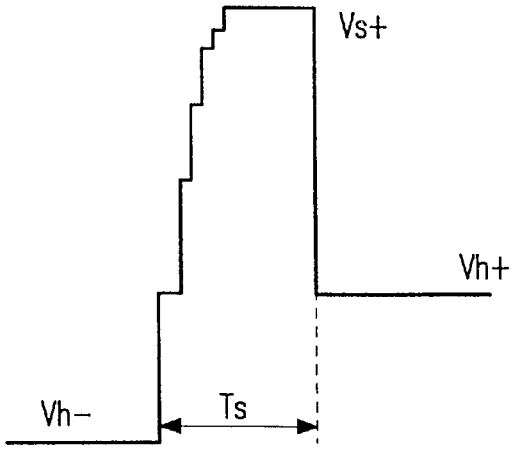

Alternative forms of shaping for the selection signals are shown in FIGS. 4 to 6, illustrating the case of a positive selection signal S+ for comparison with that of FIG. 2. In FIG. 4, the voltage is increased gradually and smoothly in a non-linear manner over an initial period Tn, the rising edge of the selection signal consequently being of variable slope (curved), until the maximum Vs+ is attained after which this level is held for the remainder of the period Ts. Rather than being ramped smoothly, similar selection signals can be obtained by increasing the voltage level in staircase fashion through switching to progressively higher voltage levels, thereby forming a series of steps, as shown in FIGS. 5 and 6.

This shaping of the selection signals enables a considerably wider range of grey-scales to be readily achieved when using pulse width modulated data signals than is possible using conventional, substantially rectangular selection signals. The grey-scale range obtainable is similar to that of a similar display device driven using amplitude modulated data signals.

Figure 7:
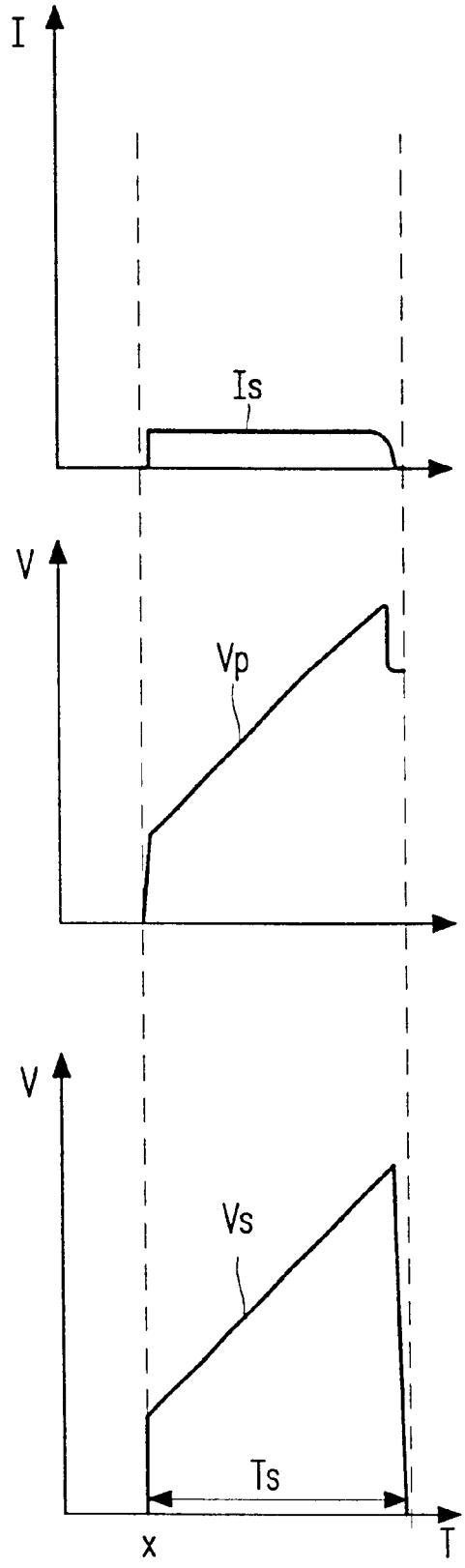
FIGS. 7 and 8 are graphs illustrating the drive voltages, display element voltages, and electrical current flowing in switching devices associated with the display elements against time in a display device according to the invention and a known display device respectively.

The reason for this capability will now be explained with reference to FIGS. 7 and 8 which illustrate graphically the relationship between a selection signal S, applied to one side of a series combination of a switching device 15 and a display element 12, the electrical current, Is, flowing through the switching device 15, and the resulting voltage on the capacitive display element, Vp, against time, T, in the case, FIG. 7, of the selection signal being shaped in the above-described manner, (in this example with the ramping extending to the end of the signal), and in the case, FIG. 8, of a conventional, substantially rectangular, selection signal. A constant, reference voltage level, serving as a white (or black) data signal, can be assumed to be applied to the other side of the series combination.

Figure 8:
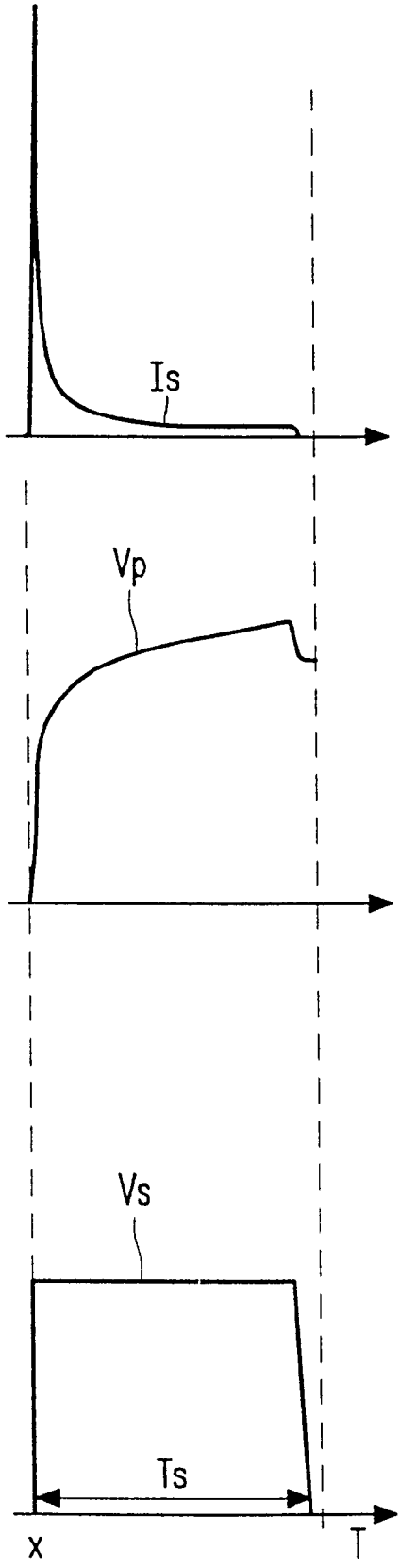

Referring to FIG. 8, the switching device 15 turns on very quickly at the start of the selection signal, point X, and it is apparent from the large spike to the profile of the current, Is, through the device that most charge is transferred to the display element in the initial few (3 to 6) microseconds of the selection signal period (30 microseconds). The display element 12 thus substantially attains its desired voltage level in these first few microseconds. This is due to the fact that the voltage across the display element capacitance cannot change instantaneously and therefore any change in the voltage between the row and column conductors appears directly across the switching device. Thereafter, as the display element capacitance charges the magnitude of the voltage, and hence current, drops to a lower level which remains generally constant for the remainder of the selection period. Because of this extreme non-linearity between the supplied charge and time, pulse width modulated data signal drive is not practical for achieving a range of grey-scale outputs from the display element when using this row drive waveform and, therefore, amplitude modulated data signals have conventionally been used to vary the display element voltage.

In contrast, the manner in which the display elements is charged when addressed using an appropriately shaped selection signal, and the form of the electrical current profile flowing through the associated switching device as a consequence, are significantly different. It is seen from FIG. 7 that when using a shaped, slow-rise, selection signal the display element charging rate is significantly modified with the current, Is, through the switching device 15 tending to a more constant level over the duration of the selection signal, and thus more constant charging of the display element. It is seen from the display element voltage curve, Vp, that this voltage gradually increases in a more linear manner over the duration of the selection signal. It will be appreciated, therefore, assuming Ts to be around 30 microseconds, that a data signal having a pulse width of about ten microseconds would give an intermediate grey scale level on a display element compared with approximately thirty microseconds width required for a fully black display element and that a wide range of intermediate levels can readily be achieved.

FIG. 9 shows schematically typical examples of pulse width modulated data signals for providing a black output (A), an intermediate grey scale level output (B), and a white, fully transmissive, output (C) and their timing relationship with a positive selection signal (D), in this case of the kind in which the ramping continues almost to the end of the selection signal. The dotted lines in FIGS. 9A, B and C signify a zero volts level. The amplitude (height) of the voltage of the data signal is selected such that with a pulse width equal to the selection signal width the display element can be driven sufficiently black for a given contrast ratio. The pulse width modulated data signals and the selection signal are shown in FIG. 9 as starting substantially simultaneously. However, the start of the selection signal may instead slightly precede or succeed the start of the data signal. It will be appreciated also that the PWM data signals for intermediate grey-scale levels need not commence at the start of the selection period, i.e. at the start (leading edge) of the selection signal. For example, such PWM data signals may be arranged instead so as to terminate simultaneously with the end (trailing edge) of the selection signal.

The nature of the current, Is, profile when using the form of shaping depicted in FIGS. 2 and 3 and the variants of FIGS. 5 and 6 using staircase ramping are generally similar, except that in the latter a series of minor ripples will be present. All current profiles have a considerably smaller peak and the current is distributed more evenly over the selection period.

With these shaped selection signals, the display element capacitance charges as the row address conductor voltage rises therefore reducing the maximum voltage which appears across the switching device. Only the leading edges of the selection signal pulses need be so modified.

The optimum shape of the current pulse through the non-linear device 15 is such that the charging current is maintained substantially constant during the major part of the selection pulse signal. If this is to be achieved the voltage across the non-linear device 15 during the selection period must remain substantially constant and so the waveform of the selection pulse should have the same shape as the voltage on the liquid crystal display element 12. Since the display element is a capacitor and the current flowing into it is substantially constant, the voltage waveform on the display element preferably is a linearly rising ramp. With a selection signal shape like that shown in FIG. 3 which consists of a rapid rise followed by a linear ramp followed by a short period at a constant voltage, the rapid rise takes the voltage across the non-linear device 15 to a level such that it starts to pass the desired constant current. The ramp voltage then rises slowly and linearly to maintain this constant current. The final, constant, voltage part of the waveform can ensure that, because there could be small variations in the ramp rate due to component tolerances, the voltage reaches a fixed final value. However this period should be made small so that $T_r$ is maximised. In a preferred form, the final constant level is omitted and the ramping is continued until the end of the signal.

Although only positive selection signals have been discussed in relation to FIGS. 4 to 9, it will of course be understood that corresponding results are similarly obtained using a suitably shaped negative selection signal (S−) and that the same principles apply to both four level and five level row drive waveform schemes.

FIG. 10 illustrates graphically, and by way of example, a measured relationship between data signal pulse width, PW, and transmission, TR, for a typical display element, both expressed in terms of percentages. As is apparent, it is easily possible to achieve a wide range of grey scales between full transmission and no transmission by varying the data signal pulse width.

The use PWM data signals means that digital column driver ICs can be used for the column drive circuit 22 which are simpler, less expensive and generally smaller than those required when using amplitude modulated data signals. Such ICs also consume less power.

Figures 11A, 11B, 11C, 11D, 11E:
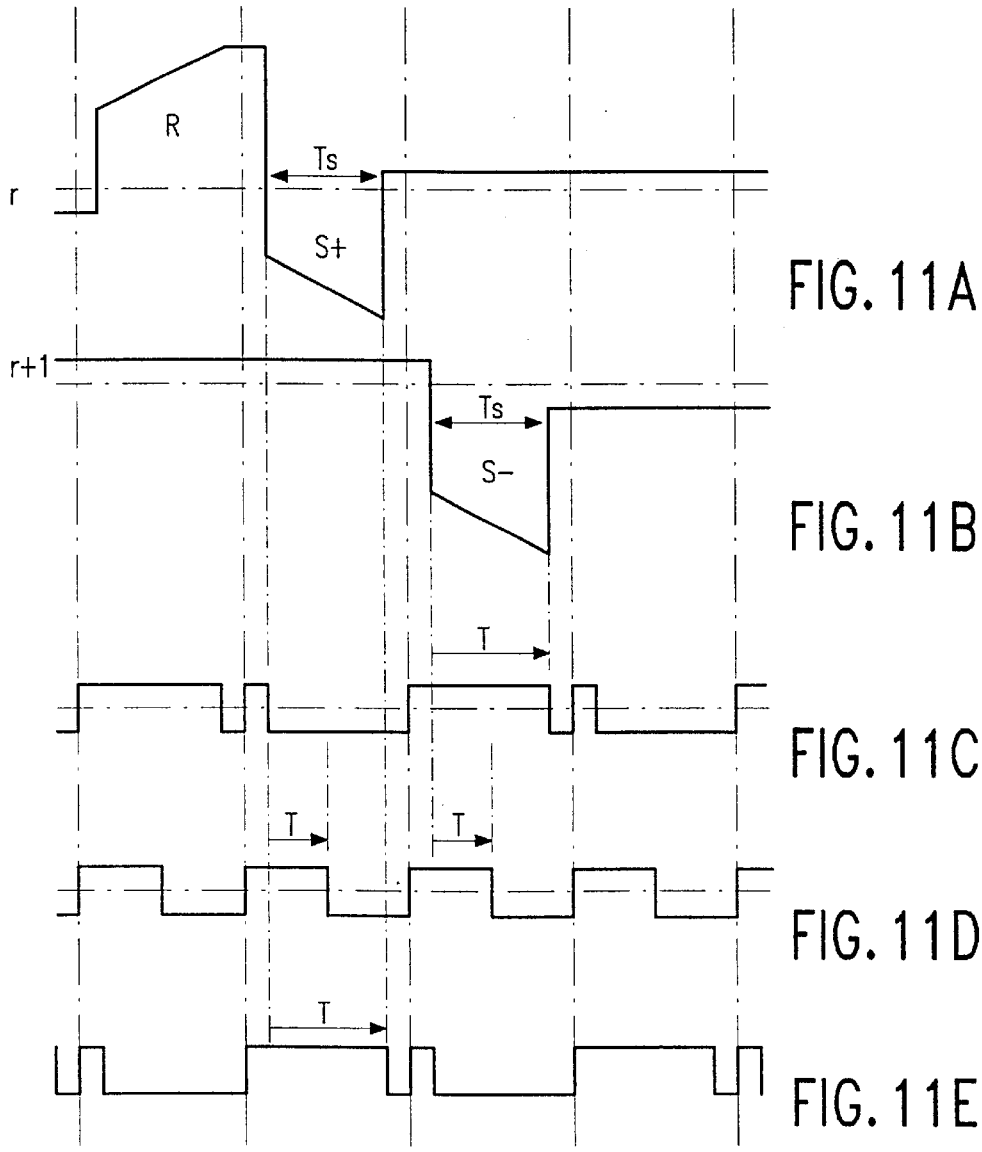
FIG. 11 shows example row and column signal waveforms present in operation of one embodiment of the display device.

FIG. 11 illustrates schematically examples of row and column conductor waveforms present in an embodiment of the display device when operating with a five level row drive waveform to produce certain display outputs. More particularly, FIGS. 11A and 11B show portions of the row drive waveforms applied to two successive row conductors, rows r and r+1, the portion for row r comprising a reset signal R and positive selection S+ signal and the portion for row r+1 comprising a negative selection signal S−. In this example a row inversion drive scheme is employed and also the ramping of the selection signals extends to the end of the pulse signal. FIGS. 11C, D and E illustrate column conductor waveforms in the case of uniform black, mid-grey, and white plain field displays respectively. With these waveforms, the column conductor voltage is such that current flows through the switching devices 15 in a selected row at the beginning of the row selection signal, is maintained for the required charging period and is then switched to a level where current flow ceases, for both the positive and negative selection signals.

Shaping of the selection signals and the use of PWM data signals as illustrated in FIG. 11 leads to almost constant current charging of the display elements. This is achieved by initially increasing rapidly the voltage on the row conductor 16 at the start of a row address period Ts, corresponding to the leading edge of the selection signals S+ or S−, until current begins to flow through the switching device 15. The voltage on the row conductor is then increased, during the ramp portion of the selection signal, more slowly and linearly so as to maintain this current. The voltage on the column conductor 17 is such that current will flow through the switching devices 15 at the beginning of the row selection signal (S+ or S−), and thereafter is maintained for the required charging period, to provide the desired display effect, before then being switched to a level at which current flow ceases.

Examples of typical charging periods are indicated in FIGS. 11C, D and E by the arrows labelled T. With regard, for example, to a black display, FIG. 11C, the charging period T in the case of a negative selection signal S− starts with the selection signal and terminates at the end of the selection signal. In the positive selection signal cycle the charging period is effectively zero. In the case of a white display, FIG. 11E, the situation is reversed with a maximum charging period T occurring during the positive selection cycle and an effectively zero charging period in the negative selection cycle. For a mid-grey display, FIG. 11D, shorter charging periods T occur in both the positive and negative selection cycles. The need to switch the voltages on the column conductors to attain these required charging periods results in rather complicated column signal waveforms being necessary.

Figures 12A, 12B, 12C, 12D, 12E:
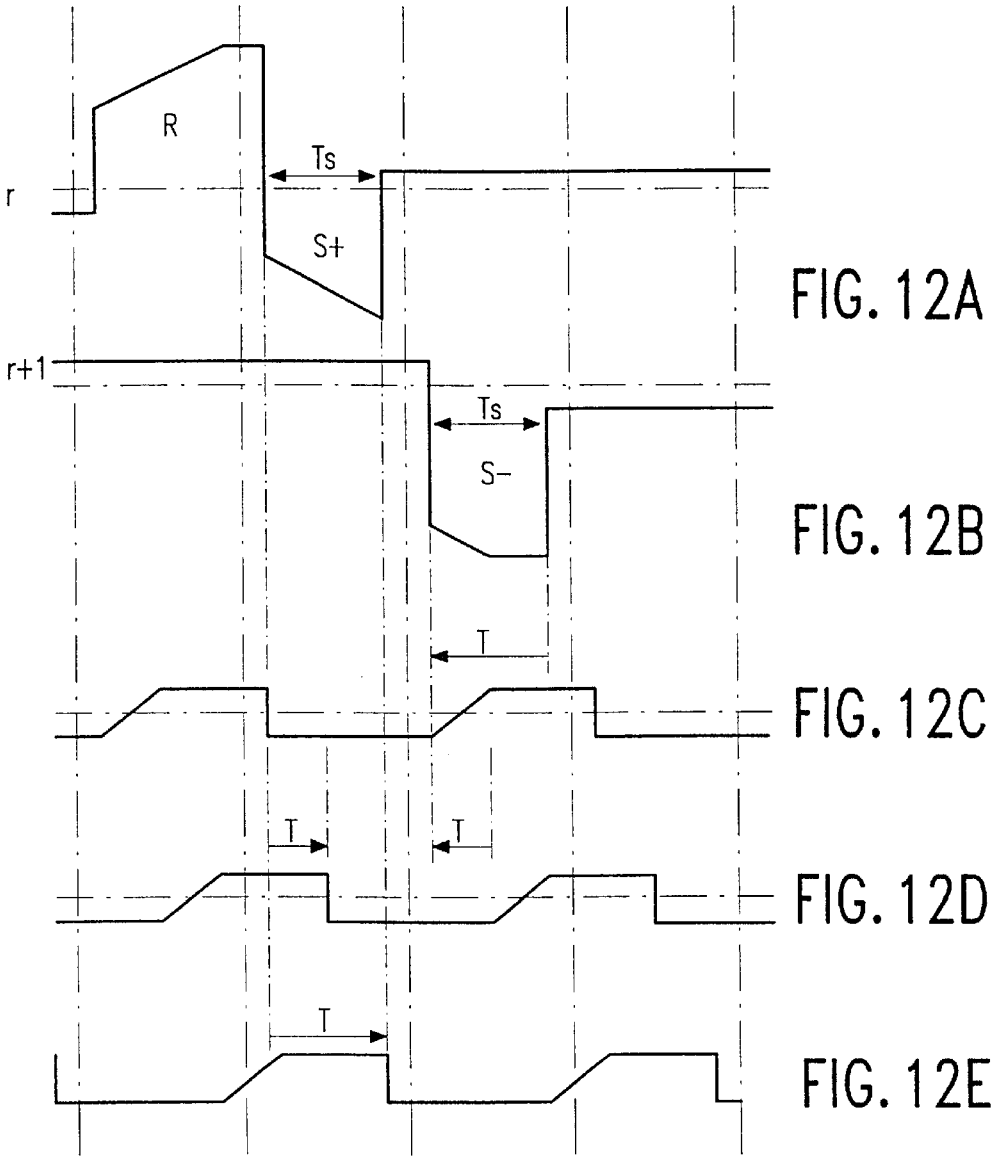
FIG. 12 shows example row and column signal waveforms in operation of another embodiment of the display device.

FIG. 12 illustrates a further, and preferred, embodiment using a modified form of column driving which results in simpler column signal waveforms. FIGS. 12A to E generally correspond to FIGS. 11A to E respectively. The drive waveforms applied to the row conductors, FIGS. 12A and B, are basically the same as in the previous embodiment, except that in this particular example the ramping applied to the negative selection signal S− does not extend to the end of the selection signal.

In this modified drive, the time controlling step, determined by the PWM data signals, is moved in the same direction for both the positive and negative selection signal periods. This leads to the charging current being switched on during the ramp part of one or other of the selection signals S+ and S− and the termination of this current flow being determined by the end of the row selection signal, rather than the end of the PWM data signal as previously. Example charging periods are again denoted by the arrows T. Considering, for example, the charging of a display element in the case of a uniform black plain field display, FIG. 12C, then during a negative selection signal S− the charging period, which needs to be a maximum, commences with the start of the selection signal S− and terminates at the end of the selection signal. If the voltage on the column conductor required for charging the display element were simply to be switched on during the ramp part of the selection signal the abrupt voltage change would give rise to a peaked charging current which increases in magnitude as the on period is reduced. As explained previously, this is undesirable because this form of current flow increases the rate of drift in the switching device 15 and also results in very non-linear LC voltage versus modulation-width characteristics. However, this problem is reduced if the column waveform is modified by replacing the step which turns on the current flow with a linear ramp that extends to approximately half the selection signal period Ts, and possibly even longer, as shown in the example column waveforms illustrated in FIGS. 12C to E. For the positive selection signal, no charging period is involved.

In the case of the negative selection signal cycle for a uniform mid-grey plain field display FIG. 12D, the charging period, this time shorter, again terminates at the end of the selection signal. In the positive selection signal cycle though the charging period is terminated by the change in the voltage of the column conductor, i.e. the end of the PWM data signal, in similar manner to the previous embodiment. In the case of a white plain field display the situation is generally opposite to that for a black display with the end of the charging period in the positive selection signal cycle, which needs to be a maximum, being determined by the end of the positive selection signal S+ and with no charging period occurring during the negative selection signal cycle.

Comparing the column signal waveforms of FIGS. 12C to E with those of FIGS. 11C to E, it will be appreciated that the former are all less complicated. It will also be apparent from FIGS. 12C to E that the column waveforms needed for the three different display outputs, black, grey and white, are all basically the same as regards the pattern of the different levels and that only the relative timing between individual parts of the waveforms and the row waveform differ. Importantly, the number of polarity reversals needed in the column signal waveforms in operation of the display device is significantly reduced. Thus, less time is wasted through the need to switch polarities and in effect more time becomes available for the actual driving of the display elements.

This modified column driving scheme can, of course, be applied to similar advantage when using four level row drive waveforms.

The desired shaping of the selection signals of the row drive waveform in the row driver circuity can be achieved in a variety of ways. The row driver circuit 20 could comprise a custom-designed row drive IC that generates the required waveforms internally. Alternatively, existing kinds of row driver circuits can be utilised with appropriate modification. Such driver circuits typically operate in effect to connect an output pin coupled to a row conductor to one of a number of voltage lines at different voltage levels by means of analog switches operating in sequence. In this case, some, or all, of the D.C. levels corresponding to the selection signal voltages can be replaced by a varying signal as appropriate or by introducing a series impedance into selected ones of the voltage supply lines. Examples of row driver circuit arrangements for producing row waveforms having shaped selection signals are described in EP-A-0699332 to which reference is invited.

While the display device above comprises liquid crystal display elements, it will be appreciated that display elements comprising other kinds of electro-optic display materials can be used.

In summary therefore, there has been disclosed an active matrix display device of the kind having two terminal non-linear switching devices such as thin film diodes connected in series with the electro-optic, e.g. LC, display elements between associated row and column address conductors in which the display elements are driven using pulse width modulated data signals and a wide range of grey-scale levels is achieved by using selection signals whose form is determined such that the current flow through the switching devices upon selection is controlled in an appropriate manner. To this end, the selection signals can be shaped to provide a more constant charging level over the selection period.

From reading the present disclosure, other modifications will be apparent to persons skilled in the art. Such modifications may involve other features which are already known in the design, manufacture and use of systems in the field of active matrix display devices and component parts thereof and which may be used instead of or in addition to features already described herein.

What is claimed is:

1. An active matrix display device comprising sets of row and column address conductors, a row and column array of electro-optic display elements operable to produce a display, each of which is connected in series with a two terminal non-linear switching device between a row conductor and a column conductor, and a drive circuit connected to the sets of row and column address conductors for applying selection signals to the row address conductors to select the rows of display elements and data signals to the column address conductors to drive the selected display elements to produce a required display effect according to a true active matrix driving scheme, wherein successive selection signals are separated by a hold voltage level, the polarity of the hold voltage alternating for successive fields, and wherein the data signals comprise pulse width modulated signals whose width determines a desired grey scale output from a display element, and wherein the drive circuit is adapted to provide selection signals which comprise voltage pulse signals whose magnitude increases to a maximum voltage amplitude such that the current flowing through a non-linear switching device during the application of a selection signal tends towards a substantially constant value.

2. An active matrix display device according to claim 1, characterised in that the selection signals are shaped such that they initially increase rapidly to a predetermined level below the maximum amplitude and then increase in a gradual and controlled manner to the maximum amplitude.

3. An active matrix display device according to claim 2, characterised in that the selection signals are ramped smoothly and linearly from the predetermined level to the maximum amplitude.

4. An active matrix display device according to claim 1, characterised in that the duration of a selection signal applied to a row address conductor is predetermined and defines an address period for a display element and in that a data signal applied to a column address conductor determines the end of an interval within the display element address period in which current flows through the non-linear switching device to drive the display element.

5. An active matrix display device according to claim 4, characterised in that the start of the selection signal determines the beginning of said interval.

6. An active matrix display device according to claim 1, characterised in that the duration of a selection signal applied to a row address conductor is predetermined and defines an address period for a display element and in that a data signal applied to a column address conductor determines the start of an interval within the display element address period in which current flows through the non-linear switching device to drive the display element.

7. An active matrix display device according to claim 6, characterised in that the end of the selection signal determines the termination of said interval.

8. An active matrix display device according to claim 6, characterised in that the data signal comprises an initial linearly ramped portion.

9. An active matrix display device according to claim 1, characterised in that the electro-optic display elements comprise liquid crystal display elements.

10. An active matrix display device according to claim 1, characterised in that the non-linear switching devices comprise thin film diode devices.

* * * * *